United States Patent [19]

Neukermans

[11] 4,030,105

[45] June 14, 1977

[54] TECHNIQUE OF CHARACTER GENERATION ON MAGNETIC TAPES

[75] Inventor: Armand P. Neukermans, Palo Alto, Calif.

[73] Assignee: Xerox Corporation, Stamford, Conn.

[22] Filed: Sept. 26, 1975

[21] Appl. No.: 617,137

[52] U.S. Cl. ..... 346/74.1

[51] Int. Cl.[2] ..... G03G 19/00

[58] Field of Search ..... 346/74.1; 346/74 EE, 346/74 ES

[56] References Cited

UNITED STATES PATENTS

| | | | |
|---|---|---|---|
| 3,608,488 | 9/1971 | Levine | 346/74.1 |
| 3,612,759 | 10/1971 | Nelson | 346/74.1 |
| 3,633,720 | 1/1972 | Tyler | 346/74.1 |
| 3,852,525 | 12/1974 | Ichioka | 346/74.1 |
| 3,890,623 | 6/1975 | Schmid | 346/74.1 |

*Primary Examiner*—Jay P. Lucas

*Attorney, Agent, or Firm*—James J. Ralabate; Richard A. Tomlin; George J. Cannon

[57] ABSTRACT

A magnetographic printing apparatus is disclosed which uses an electronically generated information stream to produce a visually readable image on a copy output medium. The high speed transfer of input information to the copy medium is accomplished by the direct writing of information pages with a magnetic write head less than the width of a page onto a magnetic buffer web. The latent magnetic image on the buffer web is transferred to a copy web wherein the pages are developed onto the copy medium at speeds approximating the direct writing time.

11 Claims, 9 Drawing Figures

TECHNIQUE OF CHARACTER GENERATION ON MAGNETIC TAPES

BACKGROUND OF THE INVENTION

1. Field of the Invention

The invention generally pertains to process and apparatus for recording information onto a copy sheet and is more particularly directed to reducing the number of magnetic writeheads necessitated by the transfer of information from a directly written latent magnetic image onto a copy sheet.

2. Description of the Prior Art

The transfer of alphanumeric data or characters onto a copy medium to produce a permanent or "hard" copy of the information is well known in the art. An early example of an apparatus useful for such transfer is a manual typewriter where an inked ribbon is selectively struck with a hammer in character configuration. Such impact printing systems have more recently become electrically controllable and have provided additional speed for the transfer of alphanumeric information. Examples of these electromechanical impact systems are automatic typewriters which, in response to an electrically developed signal, position and strike a print head containing the font to be transferred.

To increase the speed by which information can be output and to more closely match the speeds of modern data processors and communication facilities, electromechanical printers known as line printers have been developed. In the line printer art, a matrix of electronically activated print hammers are used to strike a line of print nearly simultaneously. This is accomplished normally by a rotating print drum or chain containing a prepositioned font array and other known techniques.

These electromechanical systems while possessing the attributes of great speed, in some instances up to 1,500 characters per second, are quite complex and because of their complexity, relatively expensive.

Additionally, the electromechanical nature of the prior art operation requires large amounts of energy to overcome the mechanical inertia each time an impact or character transfer takes place. Electromechanical systems of this type also generate a relatively high noise level which limits their use to special environments. Another problem encountered in such apparatus is that it requires many mechanical adjustments to insure precision in the transfer process.

To overcome many of the difficulties of the impact systems, some in the prior art have turned to impactless printing techniques.

One type of impactless printing technique used is magnetography, in which magnetic forces are used to form the visual image or character transferred to a copy medium.

Examples of ferromagnetic printing systems in the prior art are contained in a U.S. Pat. No. 3,735,416 issued to Otto et al., U.S. Pat. No. 3,161,544, and 3,254,626.

The magnetic printers in the prior art are generally line printers where only a single line of print is transferred to a copy medium at a time. This type of line-by-line printing is normally a slow and cumbersome process and does not take advantage of the speed at which a magnetic latent image forming a full page can be output onto a copy medium. Mainly, it has been ferromagnetic imaging systems that have recognized the advantages of developing a full page of information and transferring the developed image onto a hard copy output medium.

Examples of ferromagnetic imaging systems in the prior art are contained in U.S. Pat. Nos. 3,804,511 and 3,749,833, and a 3,256,191 issued to Silverberg.

As is illustrated in the art cited, many methods have been proposed for providing a magnetic latent image. An advantageous method is using a record head to lay down alternating line or matrix patterns of magnetization in a surface of magnetizable material. By writing very short lines of a small width greater resolution and better optical characteristics of the final image are enhanced. However, to retain this resolution over a common size page width, in the order of 8½ inch, a large number of such write heads must be paralleled or integrated together. For illustrative purposes, if a character width of 0.015 inch is required, on the order of 500–700 write heads must be coupled to produce the desired 8½ inch width on the copy medium.

The electronics needed to control that large quantity of write heads and the investment on each head make such a system commerically unfeasible as a direct writing system for a magnetic printer.

SUMMARY OF THE INVENTION

Therefore, it is an object of the invention to provide an impactless magnetic printer with direct writing capability.

Another object of the invention is to provide an impactless magnetic printing device with graphic or imaging capabilities.

Still another object of the invention is to reduce the number of individual recording head units that must be integrated together to provide a direct recording impactless magnetic printer.

A further object of the invention is to more closely match direct magnetic recording speeds to copy development speeds for efficient processing of information.

The invention accomplishes the foregoing objects by providing an impactless printing system using magnetography. A magnetic head assembly is pulsed by an electronic signal generator to produce alternating or matrix magnetization patterns on a magnetizable buffer web. The directly written latent image of the buffer web is then transferred to a copy web by a magnetic transfer technique. From the copy web, the image is developed with magnetic toner and thereafter transferred to a hard copy output medium.

One aspect of the invention provides a simultaneous processing of information transfer by matching the development speed of the output medium and the magnetic writing speed of the information transferred. Since a quantum (page) of information can be written with a head assembly much faster than it can be developed, the invention provides an integrated head assembly less than the width of a page. The width of the assembly is such that the ratio of the head assembly to the tape width is substantially equal to the ratio of the development speed to the magnetic writing speed. Therefore, this aspect of the invention permits a smaller number of relatively expensive write heads to be integrated and saves much of the necessary driving electronics used when writing with a full width head.

Such a system as the invention provides is substantially quieter than normal line printers and typewriters because of the impactless transfer between write head and buffer web.

By direct recording of the transferred information the printing system of the invention also provides a medium whereby alphanumeric characters can be readily output from a data processing or communication system without the sacrifice of graphical capability.

Another aspect of the invention provides multiple copy capability as the copy web provides a medium which can be processed many times and then erased.

BRIEF DESCRIPTION OF THE DRAWINGS

These and other objects, features and aspects of the invention will become clearer and more fully apparent from the following detailed description when read in conjunction with the accompanying drawings, wherein.

DETAILED DESCRIPTION OF THE PREFERRED EMBODIMENT

Figure 1:
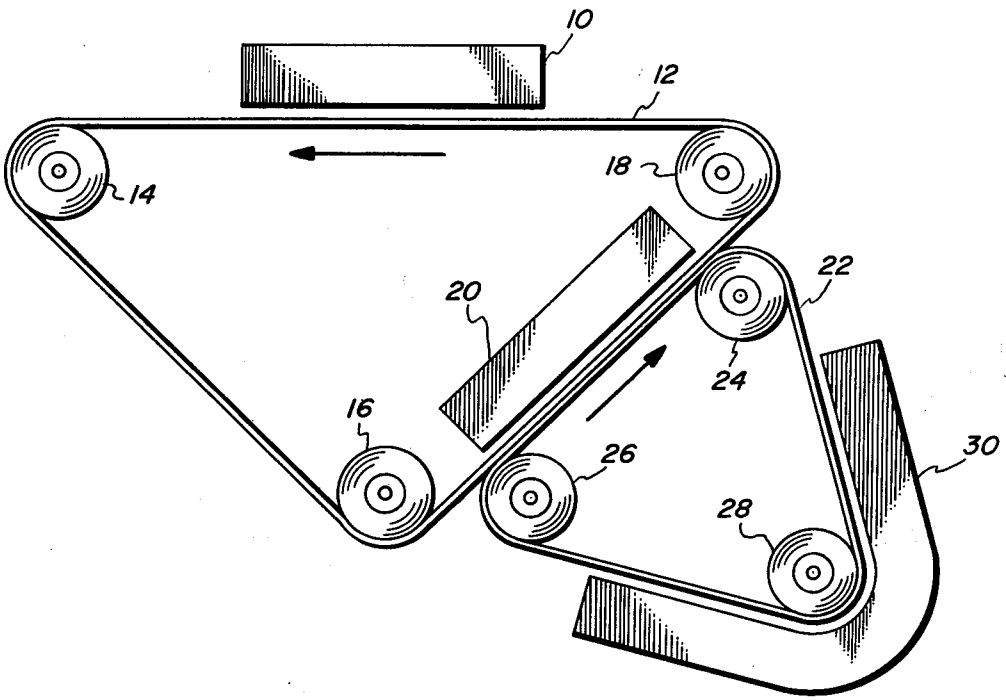
FIG. 1 is a schematic system diagram of an imaging apparatus constructed in accordance with the invention.

The invention will now be more fully explained with reference to the first illustrative system diagram, FIG. 1. A preferred embodiment of the impactless magnetographic system has a writing station 10 in physical proximity to a buffer web 12 which is entrained on a plurality of buffer web rollers 14, 16 and 18. At least one of the rollers 14, 16 or 18 is powered in a known way to provide movement of the web 12 in the direction indicated.

The writing station 10, more fully described hereinafter, directly writes a magnetic latent image onto the buffer web 12 as a series of alternating or matrix magnetization patterns to a desired resolution. After the latent magnetic image has been directly written on the buffer web 12, it is transported via the buffer web rollers 14, 16 and 18 to a position adjacent a transfer station 20.

The transfer station 20, more fully described hereinafter, provides a rapid transfer of the magnetic latent image residing on the buffer web 12 onto a copy web 22 which is carried on a plurality of copy web rollers 24, 26 and 28. At least one of the rollers 24, 26 and 28 is powered in a known way to provide movement of the web 22 in the direction indicated. During this procedure the magnetic latent image becomes fixed to the copy web 22 as a mirror image of the magnetization patterns of the magentic latent image carried on the buffer web 12. Subsequently, the magnetic latent image on the copy web 22 is transported into the vicinity of a development station 30 via the copy web rollers 24, 26 and 28.

The buffer web 12 and the copy web 22 in the preferred embodiment are magnetic tapes useful in recording magnetic information. Webs of this sort have a substrate backing of some flexible material such as Mylar or the like, and are covered with a layer of magnetic material to form a magnetizable surface. Examples of tapes useful in the system of the present invention are those having $CrO_2$ or $FeO_3$ as the recording medium.

Of course, in the present disclosure it should be recognized other magnetizable surfaces can be substituted for the webs of the preferred embodiment. A magnetic drum with a magnetic surface or a nonmagnetic drum wound with a magentic tape could also be used in the disclosed system.

The development station 30, more fully described hereinafter, develops the magnetic latent image formed on the copy tape 22 into visual image and transfers the visual image to an output medium that provides a hard copy of the original directly written information.

The transport of the magnetic latent image on the buffer web from the writing station 10 to the transfer station 20 and consequent transport of the magnetic latent image on the copy web from the transfer station 20 to the development station 30 are performed relatively rapidly. Likewise, the transfer of the magnetic latent image from the buffer web 12 to the copy web 22 also takes place at a high rate of speed.

The process is constrained in speed only by the time necessary to develop and transfer the image to an output medium by the development station 30. Therefore, one aspect of the invention provides for directly writing the magnetic latent image at a rate of speed comparable to that of the development speed of the development station 30.

Currently in the art, development speeds of approximately 50 in/sec have been achieved while surfaces have been magnetically written at up to 2,000 in/sec. The invention thereby may provide a reduction of write heads and associated electronics in the ratio of up to 40/1.

Figure 2:
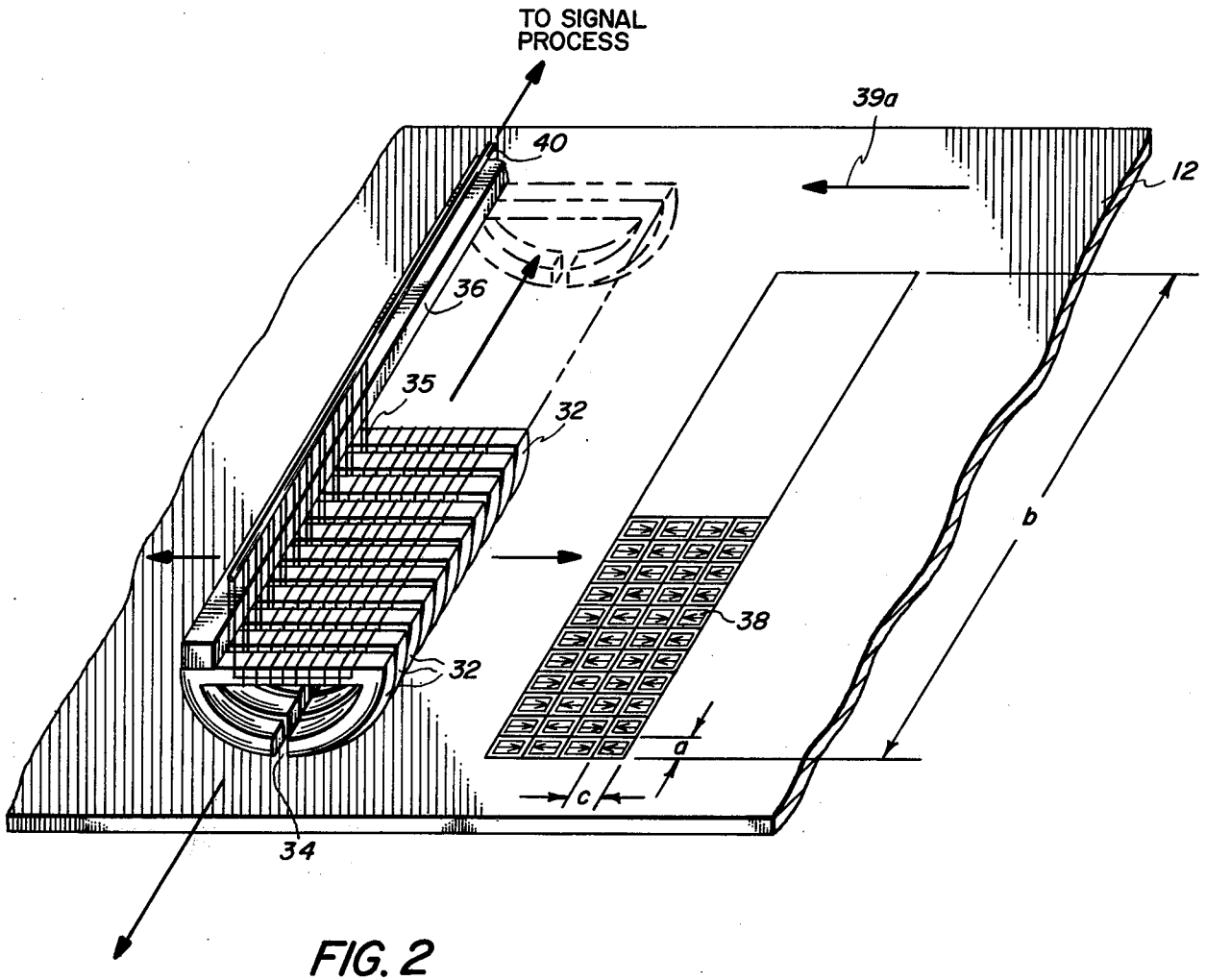
FIG. 2 is a pictorial perspective illustrative of the write head assembly for the recording station illustrated in FIG. 1.

The integrated recording head used in the recording station 20 will now be more fully described with reference to FIG. 2. The integrated recording head of less width than the tape 12 is comprised of a plurality of recording elements 32, each individually wound with a separate driving coil 35. The driving coils 35 are connected to form a signal information cable 40 which is attached to an electronic signal processor (not shown). Such signal processors are well known in the art and may take the form of character generators for forming matrix representations of alphanumerics, graphic information processors, or even video processors attached to direct scanning apparatus. The invention, by using its direct writing scheme is flexible in the electronic input presented for recording on the buffer web 12 and can receive information from a multiplicity of sources. The system then could easily be connected to a computer terminal to serve as an impactless printer for data output, or subsequently a direct scanning apparatus for copying original documents, or a real time measuring system for graphical display.

The plurality of recording elements 32 writes a pass or track of information signals of width B which include a multiplicity of microdomains 38. Each microdomain 38 may be of a polarization dependent upon the direction of the current passing through the recording element 32 and is also dependent upon the amplitude of current pulses driving the associated recording element.

Each microdomain 38 is of a width A corresponding to the width of an associated recording element 32 and of a length C determined by the recording head gap 34 of each recording element 32 and the driving frequency. Using information signals from the signal generator, the microdomains may be written in alternating lines of magnetization as for graphic information or in a preferred form for alphanumeric information may be pulsed to provide matrices that form letters and numerals. The head is free to move on a support member 36 in either the X or Y direction in the plane of the tape and is proximately located to the web to record the microdomain structure 38 described above. The tape moves in the direction indicated by arrow 39a in a preferred form, but it should be understood that the direction of the tape is not critical for the performance of the invention.

The number of recording elements 32 used for the integrated structure shown in FIG. 3 in a preferred form is related to the resolution desired, the number of heads needed to generate one alphanumeric character, the development speed, and size of the page that is desired to be written. For example, if an 8 inch wide page with a resolution width on the order of 0.015 lines/in. is to be written, on the order of 500 recording elements would be necessary to provide complete coverage for the entire information sheet. If the development speed for the system is on the order of 10 times slower than the writing speed and a single alphanumeric is to be written with five adjacent heads, then the number of recording elements 32 chosen would be 50. An advantageous writing speed for this example would be 200 in/sec with a development speed of 20 in/sec. The number of heads used in the system is then a submultiple of the total needed to write an entire page, corresponding to the writing/development speed ratio, and some multiple of the number used generating a single alphanumeric. Therefore, by multiple track writing the buffer web 12 with the integrated head described above, a great saving of head elements and electronics is accomplished without a decrease in system capacity.

Multiple passes can be performed by moving the tape in relationship to the recording head or vice versa. A number of alternatives for writing magnetic images in alphanumeric or graphic form is illustrated in FIG. 3 where the copy tape 12 is shown having a number of passes or tracks of information recorded thereon. Particularly in FIG. 3A, a page 44 may be recorded with a graphic indication such as at 42. This, in preferred form as mentioned above, is in alternating line patterns of magnetization.

Figure 3A:
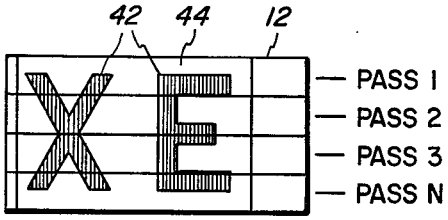
FIG. 3A–F are illustrative representations of the paths recorded by the magnetic head assembly on the buffer web illustrated in FIG. 1.
Figure 3B:
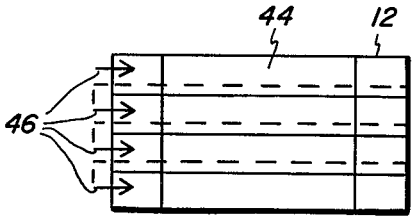

FIG. 3B shows an alternative method for making the page 44 on the copy tape 12. The recording head will move in the direction of the arrows 46 while recording and then retrace during the dotted lines to write the pagewise pattern. The tape 12 in this embodiment will remain stationary during the passes from one end to the other.

Figure 3C:
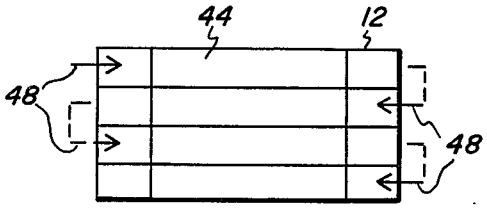

FIG. 3C, another alternative to the pagewise writing methods mentioned above, illustrates that the magnetic recording head records on the page 44 in the direction indicated by arrows 48 and then retraces along the dotted lines shown connecting the arrows 48. In this manner it can be seen that the head writes a pass in one direction and then writes an adjacent track in the opposite direction.

Figure 3D:
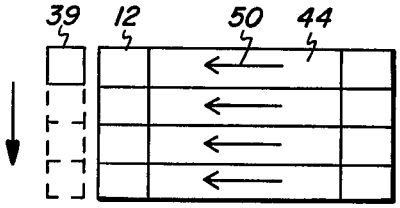

FIG. 3D is still another alternative embodiment showing the tape in movement while the head 39 moves only in a direction perpendicular to the movement of the tape. A first pass is written on the page 44 and the head subsequently is moved laterally across the tape to the next track position to write a second pass while the tape rotates the page 44 into the position for writing the next pass. The tape continues in its rotary motion until the third pass of the page is able to be written while the head 39 has been moved into position. This procedure continues until all n passes have been written on the copy tape 12.

Figure 3E:
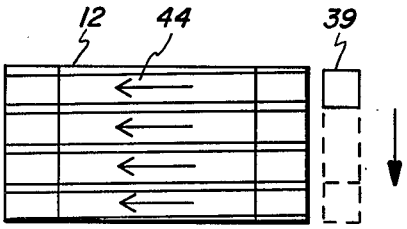

FIG. 3E also shows an alternative embodiment to the multiple pass technique taught in the previous examples. In this example, the tape 12 is in continuous movement as is the recording head 39. It is seen that the head writes the page 44 in a series of tracks that are inclined at a slight angle to the tape 12. This method has the advantage of allowing the head to move in a continuous motion and eliminates the stopping and starting of either the tape or the head. The tape is speeded up between tracks to substantially eliminate the discontinuities between tracks.

Figure 3F:
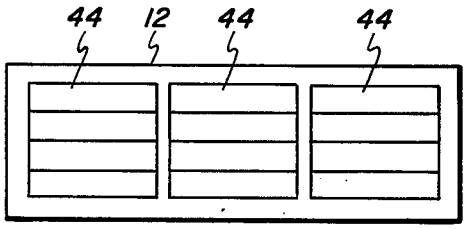

FIG. 3F is also an alternative embodiment where it is seen that multiple pages 44 may be written on the copy tape 12. When multiple pages are written on the copy tape 12 of the preceding multiple pass techniques as taught in FIGS. 3A-E may be used and others that are obvious to one skilled in the art. The multiple page technique has the advantage of providing a longer lengthwise write cycle for the head in relationship to the time that it has to move laterally to make another pass. This comes the closest to using the fast speed of the magnetic head writing in relationship to the number of passes needed to write a full page of information or full buffer web of information in accordance with the present invention.

Figure 4:
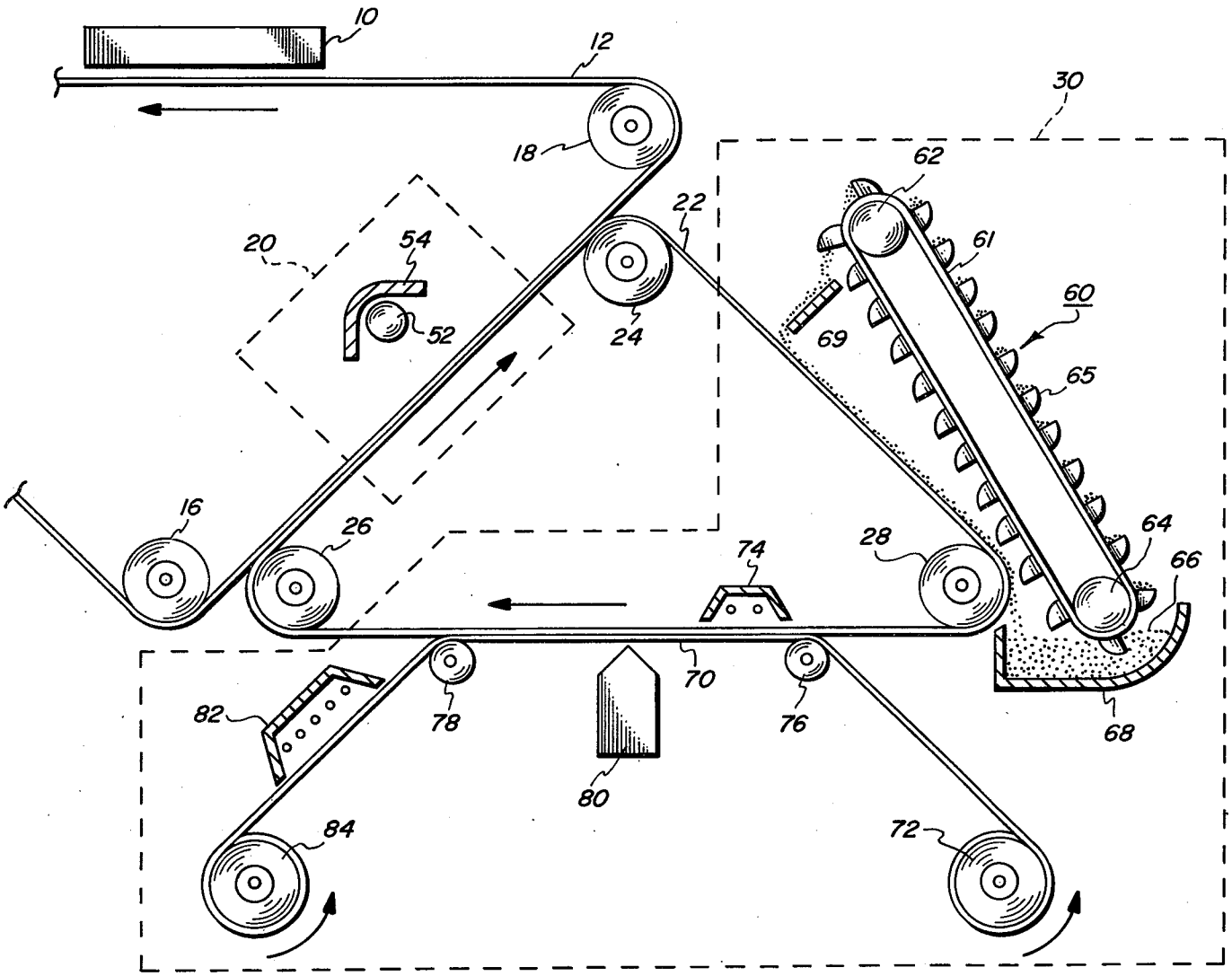
FIG. 4 is an expanded schematic diagram of the transfer station and development station illustrated in FIG. 1.

The transfer station 20 will now be more fully described in FIG. 4 where a radiant energy source 52 is used to transfer the magnetic latent image on the buffer web 12 to the copy web 22. The source 52 most conveniently is a high intensity infra-red radiator such as a Xenon flash tube.

A shield 54 is used to concentrate a short high energy burst of radiation onto the buffer web 12 and the copy web 22 combination. During the burst, the copy web 22, which has a lower Curie point temperature than the buffer web 12, is heated above its Curie point and allowed to cool in intimate contact with the buffer web. A very rapid thermoremanent transfer of the magnetic latent image is accomplished in this manner.

It should be understood that other techniques can be used for the transfer of the magnetic latent image from the buffer web 12 to the copy web 22 including an anhysteretic transfer. In that case, a high frequency magentization source would be supplied to produce a cycling of the copy web 22 around its B–H loop while in contact with the magnetic latent image of the buffer web 12. The coercivity of the buffer web would be chosen greater than the applied magnetization from the high frequency source to prevent erasure of the buffer web 12.

The matching of the writing speed to the development speed is facilitated by the transfer of the latent magnetic image from the buffer web 12 to the copy web 22. This frees the buffer web 12 for rerecording at the recording station 10 while development is taking place on the copy web 22. Thus, the decoupling of the input part of the system (recording) from the output part of the system (development) permits a greater degree of flexibility than could be obtained otherwise.

The development station 30 will now more fully be described with reference to FIG. 4 wherein there is shown developing, transferring and fixing apparatus for providing a visual development of the latent magnetic image on the copy web and a transferral to an output medium. Such a development system is described in U.S. Pat. No. 3,250,636 issued to Wilferth, the disclosure of which is herein incorporated by reference.

The latent magnetic image on copy web 22 proceeds into a toning zone where an endless belt bucket conveyor 60 dumps toner onto a deflection plate 69 to cascade develop the image with a magnetic toner 66.

A continuous supply of the magnetic toner 66 is provided by the conveyor 60 where each cup shaped conveyor bucket 65 rotates in a continuous fashion on a belt 61 entrained around conveyor rollers 62 and 64.

The toner is transferred from the magnetic toner reservoir 68 and over the top of the roller 62 to impinge upon the deflection plate 69 and flow onto the copy web 22. Excess toner flows by gravity from the latent magnetic image down the inclined web surface back into the reservoir 68. The imagewise or matrix configuration of the recorded magnetic domains causes fringing fields to hold the imagewise configuration of the toner onto the copy web.

The copy web then carrying the developed image passes into contact with a sheet of copy paper 70 from a supply roller 72. A pressure roller 76 and a pressure roller 78 hold the copy sheet 70 in intimate contact with the toned latent magnetic image on the copy web 22 and a demagnetizing heater 74 erases the image.

During the transfer, the copy web 22 and the paper 70 move over a magnet 80 which assures the transfer of the toner particles to the copy sheet 70 and then is transported over roller 78 to a takeup roll 84. Subsequent to the transfer, a resistance type heater 82 heats the toner particles on the copy paper fixing them to the copy sheet 70.

If, in this example, multiple copies are to be made the erasing of the magnetic image by the demagnetizing heater 74 is not performed but instead a number of copies can be made by the continuous transfer in form described above. During the multiple copy process the buffer web is controlled along with the writing and transferring station to hold part of the process operation until after the multiple copies are provided.

While the invention has been described in detail in relation to a number of preferred embodiments, those skilled in the art will understand that other changes in form and detail may be made therein without departing from the spirit and scope of the invention wherein all such changes obvious to one skilled in the art are encompassed in the following claims.

What is claimed is:

1. A direct recording magnetographic system comprising:

a magnetic head assembly having multiple integrated recording elements, a buffer web with a magnetizable surface;

means, controlling said magnetic head assembly, for directly writing a magnetic latent image onto the surface of the buffer web with multiple passes of said magnetic head assembly;

a copy web with a magnetizable surface;

means for transferring said magnetic latent image from the magnetic surface of the buffer web to the magnetic surface of the copy web;

means for developing said magnetic latent image on the copy web into a visual image; and means for transferring said visual image to a hard copy output medium; wherein the ratio of the width of said magnetic head assembly to the width of said buffer web is substantially equal to the ratio of the magnetic writing speed of said head assembly to the development speed of said development means and transferring speed of said transferring means.

2. A direct recording magnetographic system as defined in claim 1 wherein said transferring means transfer said magnetic latent image from said buffer web to said copy web anhysteretically.

3. A direct recording magnetographic system as defined in claim 1 wherein the number of said recording elements is a submultiple of the number necessary to write a full width page and a multiple of the number chosen to write one alphanumeric character of said latent magnetic image.

4. A direct recording magnetographic system as defined in claim 3 wherein said ratio of magnetic head assembly width to buffer web width is greater than 1 to 40.

5. A direct recording magnetographic system as defined in claim 4 wherein said ratio is approximately 1 to 10.

6. A direct recording magnetographic system as defined in claim 5 wherein said buffer web width is in the range of 7–9 inches, said magnetic writing speed is approximately 200 in/sec, said developing speed is approximately 20 in/sec, said number of recording elements needed for producing an alphanumeric character is 5, and said number of recording elements necessary to write a full page width is approximately 500.

7. A direct recording magnetographic system as defined in claim 1 wherein said transferring means transfers said magnetic latent image from said buffer web to said copy web thermoremanently.

8. A magnetographic imaging method comprising the steps of:

forming a directly written magnetic latent image on a buffer web with a magnetic head assembly, transferring said magnetic latent image from the buffer web to a copy web, developing said magnetic latent image on the copy web with magnetic toner, transferring said developed magnetic latent image to a hard copy output medium, wherein the combination of the speed at which the transfer of the magnetic latent image occurs, the speed at which the magnetic latent image is developed, and the speed at which the developed image is transferred is substantially equal to the speed at which the magnetic latent image is formed.

9. A magnetographic imaging method as set forth in claim 8 wherein the step of forming said magnetic latent image comprises writing multiple tracks of image information in a page form wherein the width of said magnetic head assembly is less than the width of said page.

10. A magnetographic imaging method as set forth in claim 9 wherein the step of writing multiple passes comprises:

a. recording a track of information the length of the page, with said head assembly, b. retracing the just recorded track without recording, c. moving said head assembly laterally from said just recorded track, and d. recording another track adjacent to the last previously written track, and e. performing steps b-e until the entire page is recorded.

11. A magnetographic imaging method, as set forth in claim 9 wherein the step of writing multiple passes comprises:

a. recording a track of information the length of the page with said head assembly, b. moving said head assembly laterally from the last previously recorded track, c. recording another track adjacent to the last previously recorded track and in the opposite direction, and d. performing step b–c until the entire page is recorded.

* * * * *